US009373922B2

(12) United States Patent
Shimoji et al.

(10) Patent No.: US 9,373,922 B2
(45) Date of Patent: Jun. 21, 2016

(54) LED ILLUMINATION DEVICE WITH EDGE CONNECTOR

(75) Inventors: Kenichi Shimoji, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 377 days.

(21) Appl. No.: 13/820,588

(22) PCT Filed: Jun. 22, 2011

(86) PCT No.: PCT/JP2011/064274
§ 371 (c)(1),
(2), (4) Date: Mar. 4, 2013

(87) PCT Pub. No.: WO2012/056761
PCT Pub. Date: May 3, 2012

(65) Prior Publication Data

US 2013/0163261 A1 Jun. 27, 2013

(30) Foreign Application Priority Data

Oct. 28, 2010 (JP) ..... 2010-242597

(51) Int. Cl.
*H01R 4/48* (2006.01)
*F21V 17/14* (2006.01)
*H01R 31/06* (2006.01)
(Continued)

(52) U.S. Cl.
CPC ..... *H01R 31/06* (2013.01); *F21V 19/003* (2013.01); *F21V 19/0055* (2013.01); *F21V 23/06* (2013.01); *H01R 13/74* (2013.01); *F21K 9/13* (2013.01); *F21V 3/02* (2013.01);
(Continued)

(58) Field of Classification Search
CPC ... F21V 17/14; F21V 19/0005; F21V 19/001; F21V 19/003; F21V 19/0045; F21V 19/006; F21V 19/0065; F21Y 2105/001; H01R 4/48; H01R 9/0735; H01R 9/091; H01R 12/721
See application file for complete search history.

(56) References Cited

U.S. PATENT DOCUMENTS 5,213,518 A 5/1993 Weidler
6,502,968 B1 * 1/2003 Simon ..... 362/489
(Continued)

FOREIGN PATENT DOCUMENTS

CN 201547697 U 8/2010
CN 102121599 A 7/2011
(Continued)

OTHER PUBLICATIONS

Extended European Search Report in EP 14186662.4 mailed Jan. 12, 2015 12, 2014.
(Continued)

*Primary Examiner* — Ismael Negron
(74) *Attorney, Agent, or Firm* — Collard & Roe, P.C.

(57) ABSTRACT

An illumination device comprises a support plate 22 having a front surface 22*a* and a back surface 22*b* facing each other in a plate thickness direction and an opening 22*d* passing through in the plate thickness direction; a light source module 23 placed on the front surface of the support plate; a drive circuit portion 33 for driving the light source module; and a connector 27 connecting the drive circuit portion to the light source module. The connector is inserted through the opening of the support plate and brought into contact with the back surface of the support plate.

11 Claims, 9 Drawing Sheets

(51) Int. Cl.

| | |
|---|---|
| ***F21V 19/00*** | (2006.01) |
| ***F21V 23/06*** | (2006.01) |
| ***H01R 13/74*** | (2006.01) |
| *H01R 12/72* | (2011.01) |
| *H01R 12/75* | (2011.01) |
| *F21K 99/00* | (2016.01) |
| *F21Y 101/02* | (2006.01) |
| *F21V 3/02* | (2006.01) |

(52) U.S. Cl.
CPC ..... *F21Y 2101/02* (2013.01); *H01R 12/721* (2013.01); *H01R 12/75* (2013.01)

(56) References Cited

U.S. PATENT DOCUMENTS

| | | | | |
|---|---|---|---|---|
| 6,582,100 | B1 | 6/2003 | Hochstein et al. | |
| 6,949,772 | B2 * | 9/2005 | Shimizu et al. | 257/99 |
| 7,470,160 | B1 * | 12/2008 | Mostoller et al. | 439/874 |
| 7,892,031 | B1 * | 2/2011 | Mostoller et al. | 439/611 |
| 8,227,964 | B2 * | 7/2012 | Choi et al. | 313/46 |
| 8,425,082 | B2 * | 4/2013 | Wang | 362/249.02 |
| 2005/0207151 | A1 | 9/2005 | Aanegola et al. | |
| 2006/0262545 | A1 | 11/2006 | Piepgras et al. | |
| 2008/0232116 | A1 * | 9/2008 | Kim | 362/365 |
| 2010/0097811 | A1 * | 4/2010 | Betsuda | 362/362 |
| 2010/0177515 | A1 * | 7/2010 | Shoushtari | 362/249.02 |
| 2010/0267289 | A1 | 10/2010 | Urano | |
| 2010/0271834 | A1 * | 10/2010 | Muessli | 362/398 |
| 2011/0140136 | A1 | 6/2011 | Daily et al. | |
| 2012/0087137 | A1 * | 4/2012 | Lay et al. | 362/373 |
| 2012/0170261 | A1 * | 7/2012 | Hu et al. | 362/217.16 |
| 2013/0082595 | A1 * | 4/2013 | Yamamoto et al. | 315/50 |

FOREIGN PATENT DOCUMENTS

| | | | |
|---|---|---|---|
| DE | 298 22 575 | U1 | 4/2000 |
| EP | 0 722 205 | A2 | 7/1996 |
| EP | 2 333 407 | A1 | 6/2011 |
| EP | 2 556 297 | A1 | 2/2013 |
| EP | 2 579 392 | A1 | 4/2013 |
| GB | 2 348 324 | A | 9/2000 |
| JP | 6-45033 | | 2/1994 |
| JP | 2005-217354 | A | 8/2005 |
| JP | 2006-40727 | | 2/2006 |
| JP | 2006-80014 | A | 3/2006 |
| JP | 2007-273205 | | 10/2007 |
| JP | 4097231 | | 3/2008 |
| JP | 2010 165627 | A | 7/2010 |
| WO | 2010/101405 | A2 | 9/2010 |
| WO | 2011/064108 | A1 | 6/2011 |
| WO | 2011/124974 | A1 | 10/2011 |

OTHER PUBLICATIONS

Supplementary European Search Report in EP 11 83 5902 mailed Mar. 12, 2014.
Chinese Office Action in CN 201180043263.5, issued on Jul. 30, 2014, with English translation of relevant parts.
Extended European Search Report in EP 14186668.1 mailed Nov. 25, 2014.
International Search Report of PCT/JP2011/064274, date of mailing Sep. 27, 2011.

* cited by examiner

LED ILLUMINATION DEVICE WITH EDGE CONNECTOR

CROSS REFERENCE TO RELATED APPLICATIONS

This application is the National Stage of PCT/JP2011/064274 filed on Jun. 22, 2011, which claims priority under 35 U.S.C. §119 of Japanese Application No. 2010-242597 filed on Oct. 28, 2010, the disclosure of which is incorporated by reference. The international application under PCT article 21(2) was not published in English.

TECHNICAL FIELD

This invention relates to an illumination device and a connector for use therein.

BACKGROUND ART

In recent years, there have been developed illumination devices (hereinafter referred to as "LED bulbs") having light-emitting diodes (hereinafter referred to as "LEDs") as light-emitting elements. There is available an LED bulb comprising a module (herein referred to as a "light source module") which is formed by mounting LEDs on a circuit board. The LED bulb comprising the light source module is configured to be driven by supplying power to the LEDs through the circuit board, thereby obtaining desired illumination.

The amount of heat generation of the LEDs during power supply is generally large and therefore it is not proper to use solder at a power supply portion of the light source module. This is because there is a possibility that the solder is broken due to the heat generated by the LEDs.

Patent Document 1 proposes to use a connector at a power supply portion of a light source module in an LED bulb.

Herein, the technique disclosed in Patent Document 1 will be briefly described with reference to FIG. 5. A socket 1 comprises a socket base 2 and contacts 3 disposed inside the socket base 2. A plug 4 comprises contacts (not illustrated) to which wiring wires 5 are connected. A module board 6 comprises a connecting portion 6*a*. The plug 4 is inserted into the socket base 2 from its one side so that the contacts of the plug 4 are brought into contact with the contacts 3 of the socket 1. The module board 6 is inserted into the socket base 2 from its opposite side so that the connecting portion 6*a* is brought into contact with the contacts 3 of the socket 1. As a result, the wiring wires 5 are electrically connected to the module board 6 through the contacts 3. Accordingly, desired illumination can be obtained by supplying power to the module board 6. The socket base 2 is fixed to a mounting object of the module board 6 by the use of separate components such as screws.

PRIOR ART DOCUMENT

Patent Document

Patent Document 1: Japanese Patent (JP-B) No. 4097231

SUMMARY OF THE INVENTION

Problem to be Solved by the Invention

According to the technique shown in FIG. 5, it is possible not to use solder at the power supply portion of the module board 6. However, since the configuration is such that the plug 4 and the module board 6 are inserted into the socket base 2 in the directions opposite to each other, a large space is required on the mounting object and thus it is difficult to miniaturize an illumination device. Further, since the special components are used for fixing the socket base 2 to the mounting object, the number of components increases to make the management thereof complicated and further the operation of attaching the socket base 2 is required, resulting in high cost.

It is therefore an object of this invention to provide an illumination device which is miniaturized and low-priced by attaching a connector in a small space without using a special component.

It is another object of this invention to provide a connector which is suitable for use in the above-mentioned illumination device.

Means for Solving the Problem

An illumination device according to a first aspect of the present invention is characterized by comprising a support plate having a front surface and a back surface facing each other in a plate thickness direction and an opening passing through in the plate thickness direction, a light source module placed on the front surface of the support plate, a drive circuit portion for driving the light source module; and a connector connecting the drive circuit portion to the light source module, wherein the connector is inserted through the opening and brought into contact with the back surface of the support plate.

An illumination device according to a second aspect of the present invention is characterized by comprising a support plate having a front surface and a back surface facing each other in a plate thickness direction and an opening passing through in the plate thickness direction, a light source module placed on the front surface of the support plate, and a connector inserted through the opening, wherein the connector is brought into contact with the back surface of the support plate so as to be supported in the plate thickness direction jointly with the light source module.

A connector according to a third aspect of the present invention is characterized by comprising an insulating housing and a conductive terminal held by the housing, wherein the housing has a first fitting portion on one end side in a vertical direction and a second fitting portion on an opposite end side, wherein the first fitting portion faces in a direction crossing the vertical direction, and wherein the terminal has a grasping portion that grasps a first connection object in the vertical direction in the first fitting portion and a contact terminal portion that is brought into contact with a second connection object in the second fitting portion.

Effect of the Invention

According to the illumination device of each of the first and second aspects of this invention, the connector is attached in a small space without using a special component so that the illumination device can be miniaturized and low-priced.

The connector according to the third aspect of this invention is suitable for use in the illumination device according to each of the first and second aspects.

MODE FOR CARRYING OUT THE INVENTION

First, referring to FIGS. 1A to 1C, the overall structure of an illumination device according to an embodiment of this invention will be described.

Figure 1A:
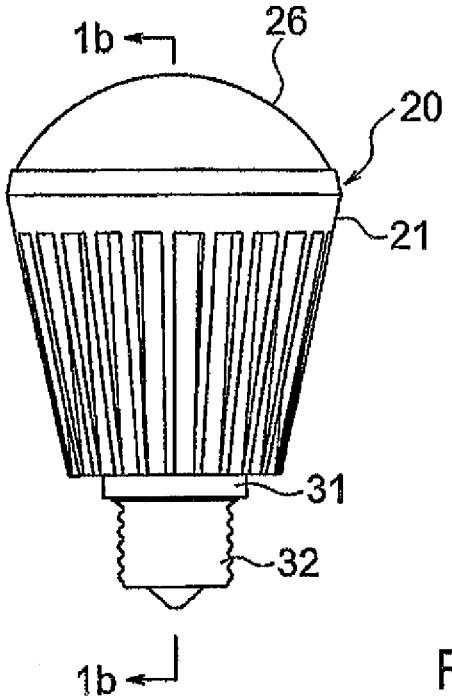
FIG. 1A is a side view of an illumination device according to an embodiment of this invention.
Figure 1B:
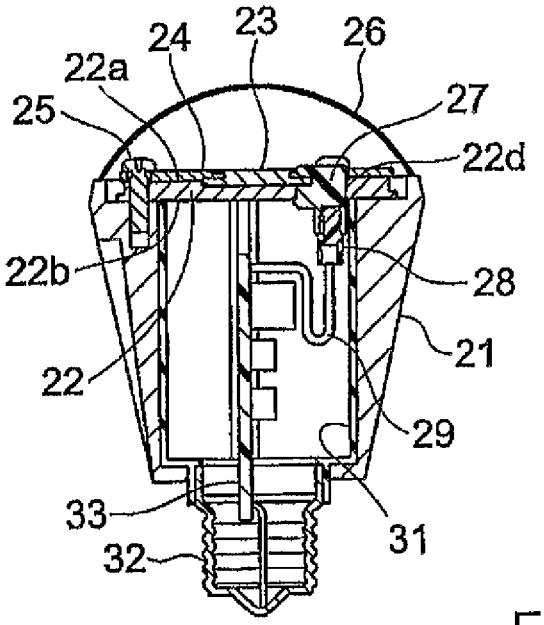
FIG. 1B is a cross-sectional view taken along line 1*b*-1*b* of FIG. 1A.
Figure 1C:
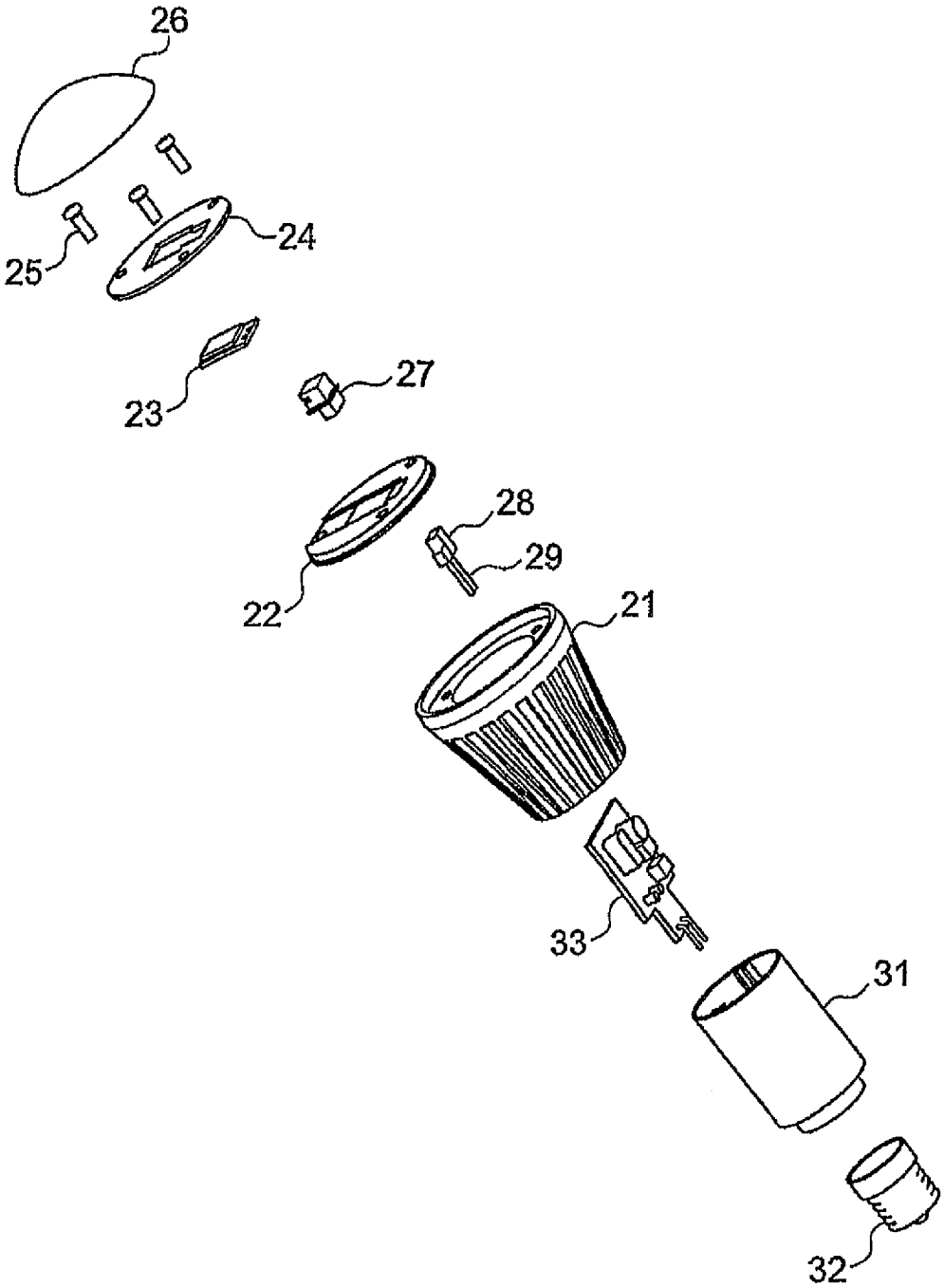
FIG. 1C is an exploded perspective view of the illumination device shown in FIG. 1A.

An illumination device 20 shown in FIGS. 1A to 1C is a bulb-type lamp in which a generally disc-shaped support plate 22 serving also as a heat transfer member is disposed at one end, i.e. on the upper end side, of a tubular heat radiating member 21. The heat radiating member 21 and the support plate 22 are each made of a metal excellent in heat transfer property, such as aluminum.

A light source module 23 having a generally square shape in plan view is disposed on an upper surface (front surface) of the support plate 22. Further, a cover plate 24 is placed so as to partially overlap a peripheral portion of the light source module 23. The cover plate 24 and the support plate 22 are fixed to the heat radiating member 21 by a plurality of screws 25. As a result, the light source module 23 is prevented from moving upward by the cover plate 24 and thus is kept closely contacting to the support plate 22. The light source module 23 is configured such that one or a plurality of light-emitting elements using a light-emitting diode/diodes (hereinafter referred to as "LED/LEDs") or the like is/are integrally mounted on an upper surface of a circuit board at its central portion.

A domed cover 26 is also attached to the upper surface of the support plate 22 so as to cover the light source module 23 with a space therebetween. The domed cover 26 is made of a glass, a transparent/semitransparent resin, or the like.

A fixed-side connector 27 is also attached to the support plate 22. The fixed-side connector 27 is electrically connected to the light source module 23 and contributes to power supply to the LED/LEDs. The structure of the fixed-side connector 27 and its attaching structure to the support plate 22 will be clarified later.

A movable-side connector, i.e. a power supply connector 28, is fitted and connected to the fixed-side connector 27. Two power supply cables 29 are drawn downward from the power supply connector 28.

A tubular receiving portion 31 is fittingly disposed in the heat radiating member 21. A lower portion of the receiving portion 31 is exposed to the outside from the heat radiating member 21 and is attached with a base 32.

A drive circuit portion 33 is disposed in the receiving portion 31. The drive circuit portion 33 has various electronic components such as a capacitor and a transformer and is electrically connected to the above-mentioned two power supply cables 29 and the base 32.

In this manner, the power can be supplied to the light source module 23 through the base 32, the drive circuit portion 33, the power supply cables 29, the power supply connector 28, and the fixed-side connector 27.

Herein, for convenience of description, the support plate 22, the light source module 23, the fixed-side connector 27, the power supply connector 28, and the power supply cables 29 are collectively called a module assembly.

Next, referring to FIGS. 2A to 2D, the fixed-side connector 27 will be described.

The fixed-side connector 27 comprises an insulating housing 41 and two conductive terminals 42 held by the housing 41.

The housing 41 has a first fitting portion 43 on the upper end side in the vertical direction, a second fitting portion 44 on the opposite end side, i.e. the lower end side, and an outward flange 45 integrally formed on an outer peripheral surface between the first fitting portion 43 and the second fitting portion 44. The first fitting portion 43 has a groove 43*a* which is open on the front side and extends in a direction crossing the vertical direction, i.e. in the lateral direction. The second fitting portion 44 has an opening 44*a* which is open downward. The housing 41 also has, on its rear side, two terminal receiving grooves 46 which are spaced apart from each other.

The two terminals 42 are each manufactured by punching a metal plate and each have a grasping portion 47 on the upper end side, a contact terminal portion 48 on the lower end side, and a press-fitting portion 49 formed between the grasping portion 47 and the contact terminal portion 48. The grasping portion 47 has a pair of elastically deformable portions 47*a* which are elastically deformable and a pair of contact portions 47*b* which are formed at end portions of the elastically deformable portions 47*a*. The contact terminal portion 48 has a pin portion 48*a*.

Figure 2A:
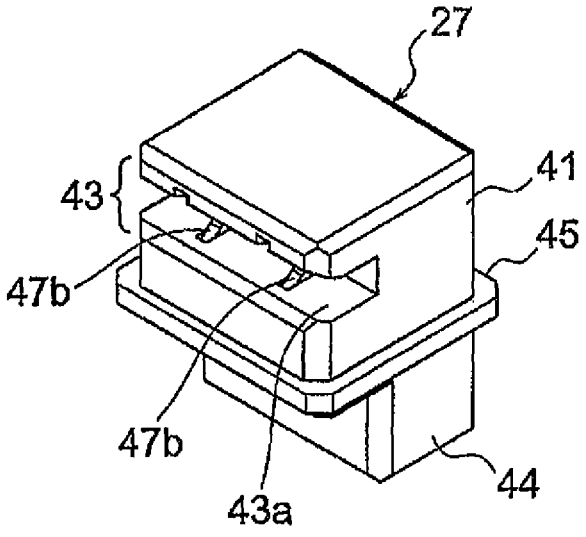
FIG. 2A is a perspective view of a connector used in the illumination device shown in FIGS. 1A to 1C.
Figure 2B:
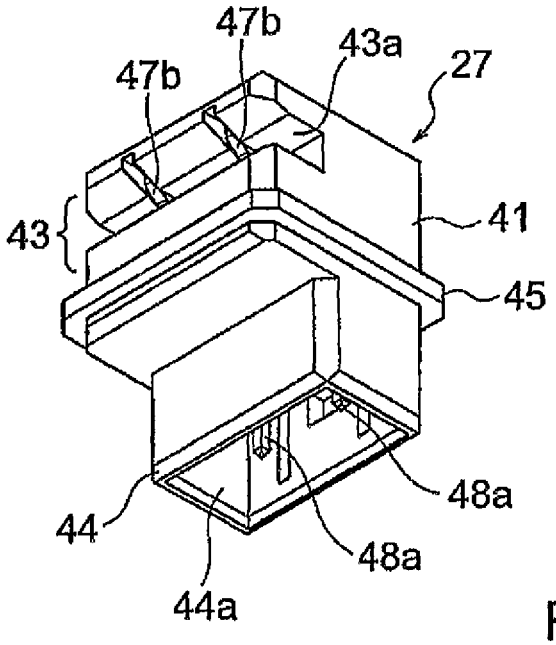
FIG. 2B is a perspective view, as seen from a different direction, of the connector shown in FIG. 2A.
Figure 2C:
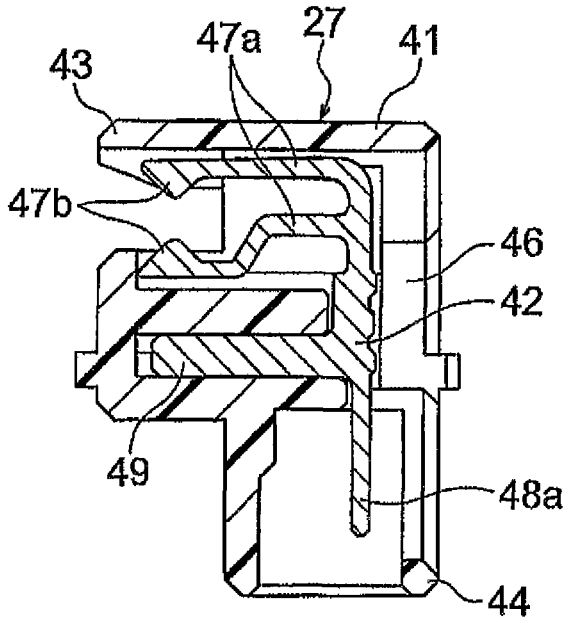
FIG. 2C is a cross-sectional side view of the connector shown in FIG. 2A.
Figure 2D:
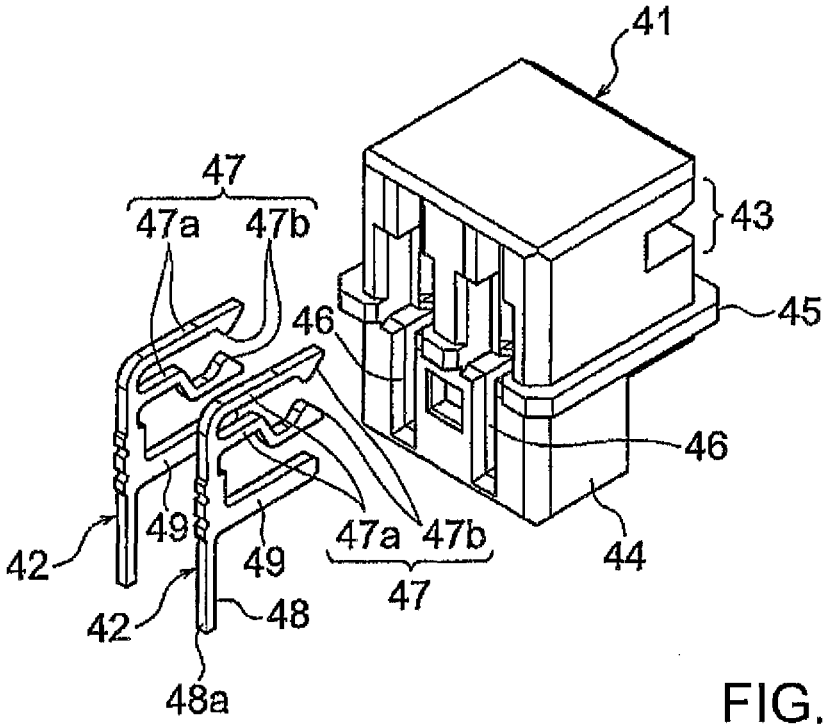
FIG. 2D is an exploded perspective view of the connector shown in FIGS. 2A and 2B.

The two terminals 42 are respectively inserted into the two terminal receiving grooves 46 from the rear side of the housing 41 and are held to the housing 41 by the press-fitting portions 49 (see FIG. 2C). In this event, the pair of contact portions 47*b* of each grasping portion 47 protrudes into the groove 43*a* of the first fitting portion 43 in a state where the contact portions 47*b* face each other. On the other hand, the pin portions 48*a* of the contact terminal portions 48 are disposed in the opening 44*a* of the second fitting portion 44.

Further, referring also to FIGS. 3A to 3D, the module assembly will be described.

Figure 3A:
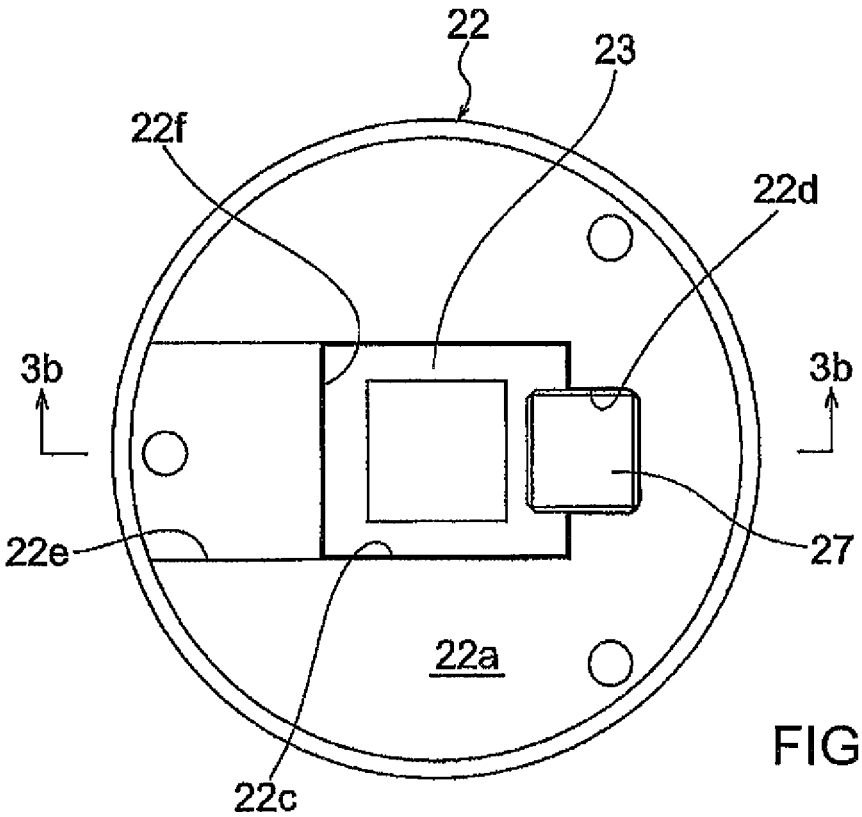
FIG. 3A is a plan view of a module assembly which is a part of the illumination device shown in FIGS. 1A to 1C.
Figure 3B:
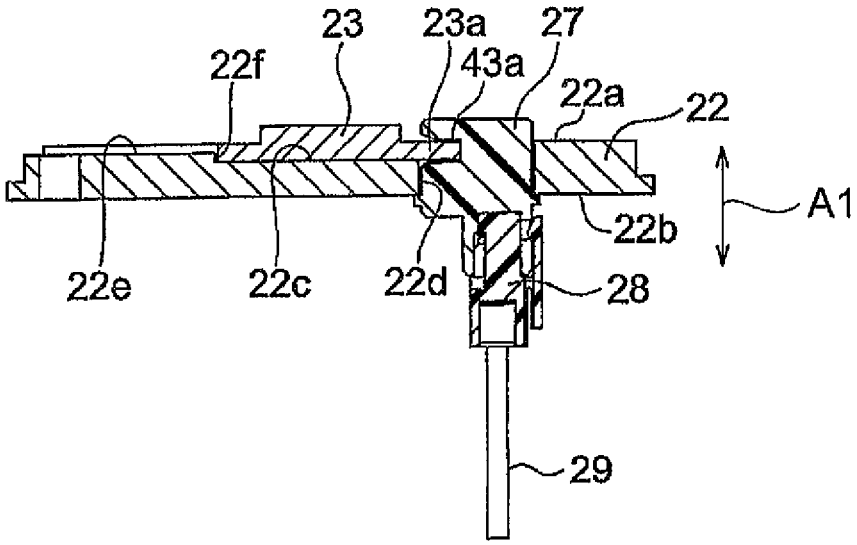
FIG. 3B is a cross-sectional view taken along line 3*b*-3*b* of FIG. 3A.
Figure 3C:
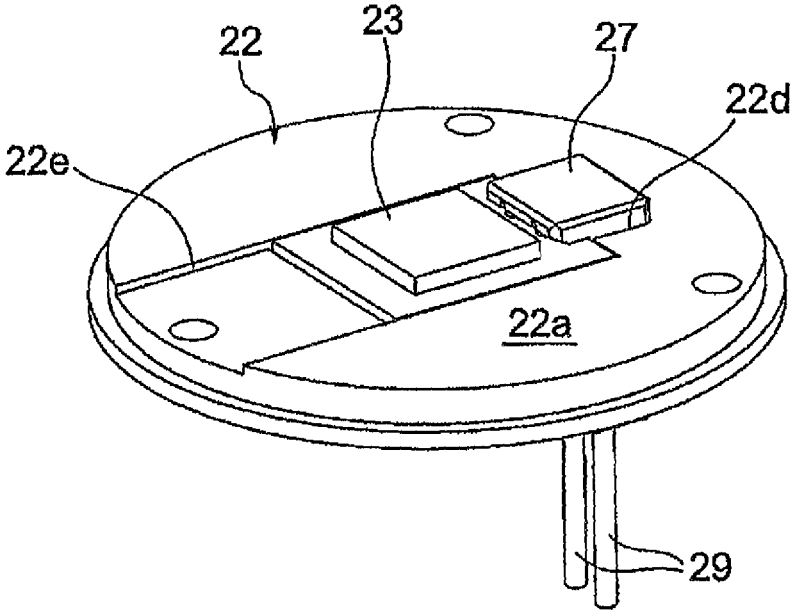
FIG. 3C is a perspective view of the module assembly shown in FIG. 3A.
Figure 3D:
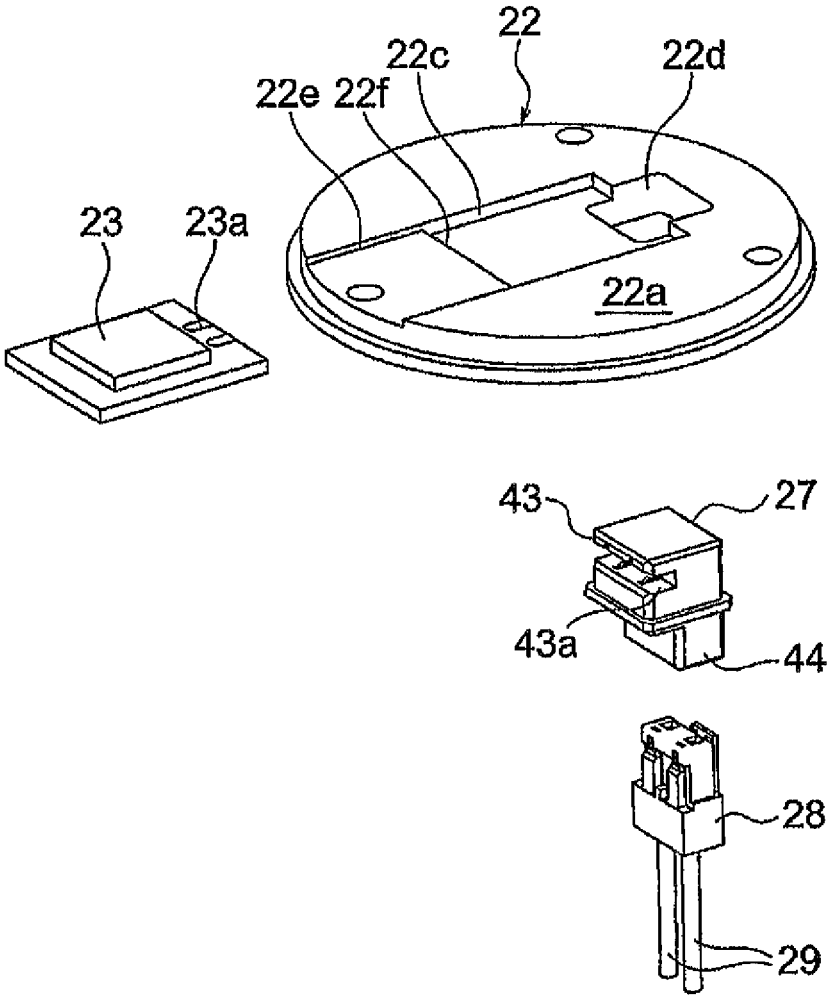
FIG. 3D is an exploded perspective view of the module assembly shown in FIGS. 3A to 3C.

In FIG. 3D, the support plate 22 has an upper surface (front surface) 22*a* and a lower surface (back surface) 22*b* facing each other in a plate thickness direction, a receiving recess 22*c* formed at a central portion of the upper surface 22*a*, an opening 22*d* located adjacent to the receiving recess 22*c* on one side thereof and passing through in the plate thickness direction (A1 in FIG. 3B), and a guide recess 22*e* formed adjacent to the receiving recess 22*c* on the opposite side thereof.

Since the receiving recess 22*c* is a portion for receiving therein the light source module 23, the plan-view shape thereof is designed to be the same as that of the light source module 23. Further, the depth of the receiving recess 22*c* is designed to be equal to the thickness of the peripheral portion of the light source module 23.

Since the opening 22*d* is a portion into which an upper portion of the fixed-side connector 27 is inserted from the lower side of the support plate 22, the plan-view shape thereof is designed to be the same as the cross-sectional shape of the upper portion of the fixed-side connector 27. To be exact, the opening 22*d* is formed at a position slightly cutting into the receiving recess 22*c*.

Since the guide recess 22*e* is a portion for guiding the light source module 23 when it is received into the receiving recess 22*c*, the width thereof is designed to be equal to or slightly greater than that of the light source module 23. The depth of the guide recess 22*e* is designed to be shallower than that of the receiving recess 22*c* and, as a result, a level difference 22*f* is formed at the boundary between the guide recess 22*e* and the receiving recess 22*c*.

Next, assembly of the module assembly will be described.

First, the upper portion of the fixed-side connector 27 is inserted into the opening 22*d* from the lower side of the support plate 22 so that the flange 45 of the fixed-side connector 27 is brought into contact with the lower surface 22*b* of the support plate 22. In this event, the groove 43*a* of the fixed-side connector 27 is disposed at a position corresponding to the receiving recess 22*c*. In this state, the light source module 23 is inserted into the guide recess 22*e* with its connecting portion 23*a* at the head and is caused to further slide toward the receiving recess 22*c*. In this manner, the light source module 23 is received into the receiving recess 22*c* while it is slightly inclined due to the level difference 22*f* when moving from the guide recess 22*e* to the receiving recess 22*c*. When the light source module 23 is completely received in the receiving recess 22*c*, the connecting portion 23*a* is inserted into the groove 43*a* of the fixed-side connector 27 as clearly shown in FIG. 3B. As a result, the connecting portion 23*a* is grasped by the grasping portions 47 of the terminals 42. Specifically, the contact portions 47*b* of the terminals 42 are pressed against both surfaces of the connecting portion 23*a* by elastic restoring forces of the elastically deformable portions 47*a* of the terminals 42.

The light source module 23 completely received in the receiving recess 22*c* is prevented from returning to the guide recess 22*e* due to engagement with the level difference 22*f*. That is, the position of the light source module 23 is determined by the cooperative action of the fixed-side connector 27 and the level difference 22*f*.

Further, in this state, the first fitting portion 43 of the fixed-side connector 27 engages with the light source module 23 in the plate thickness direction of the support plate 22. As a result, the fixed-side connector 27 inserted into the opening 22*d* of the support plate 22 is further supported in the plate thickness direction of the support plate 22 by the flange 45 of the fixed-side connector 27 and the light source module 23. Consequently, the fixed-side connector 27 is attached to the support plate 22 with a small number of components without using a special component and by the relatively simple operation.

The power supply connector 28 connected to the power supply cables 29 is fitted and connected, from below the support plate 22, to the fixed-side connector 27 attached to the support plate 22 (see FIG. 3B). As a result, the power supply cables 29 are electrically connected to the terminals 42 of the fixed-side connector 27 through the power supply connector 28. Therefore, without soldering to the power supply portion of the light source module 23, the power can be supplied to the light source module 23 from the power supply cables 29 through the power supply connector 28 and the fixed-side connector 27.

Figure 4:
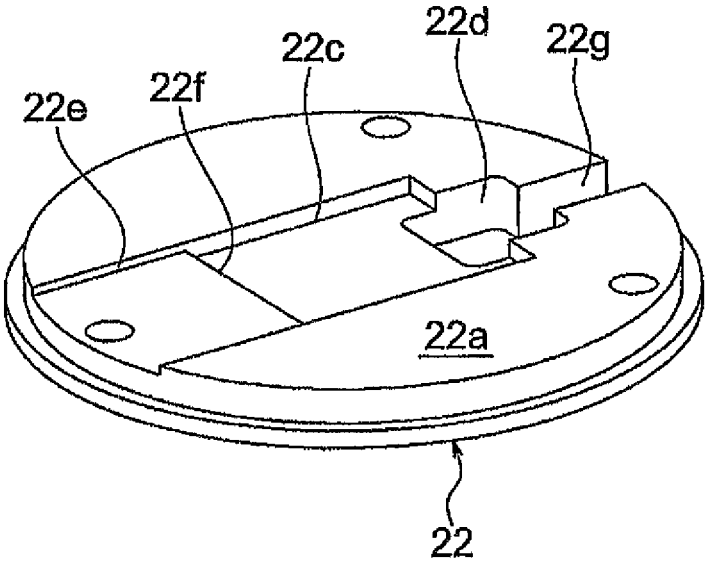
FIG. 4 is a perspective view showing a modification of a support plate which is a part of the module assembly shown in FIGS. 3A and 3B.
Figure 5:
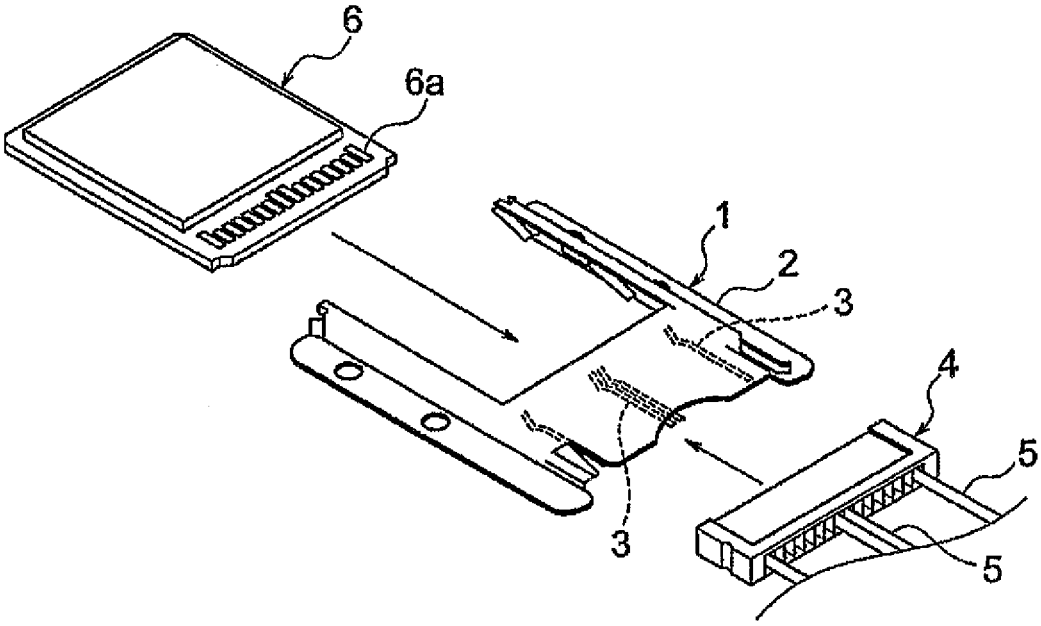
FIG. 5 is a perspective view for explaining the technique disclosed in Patent Document 1 (Japanese Patent (JP-B) No. 4097231).

While the opening 22*d* of the support plate 22 is shown as a through hole in FIGS. 3A to 3D, a cutout 22*g* which is formed to be open to an outer peripheral surface of the support plate 22 may communicate with the opening 22*d* as shown in FIG. 4.

This invention is not limited to the above-mentioned embodiment. Part or the whole thereof can also be described as the following supplementary notes but is not limited thereto.

(Supplementary Note 1)

An illumination device characterized by comprising a support plate 22 having a front surface 22*a* and a back surface 22*b* facing each other in a plate thickness direction and an opening 22*d* passing through in the plate thickness direction, a light source module 23 placed on the front surface of the support plate, a drive circuit portion 33 for driving the light source module, and a connector 27 connecting the drive circuit portion to the light source module, wherein the connector is inserted through the opening and brought into contact with the back surface of the support plate.

(Supplementary Note 2)

The illumination device according to supplementary note 1, wherein the support plate has a level difference 22*f* which determines a position of the light source module in cooperation with the connector.

(Supplementary Note 3)

The illumination device according to supplementary note 1 or 2, wherein the light source module has a connecting portion 23*a*, wherein the connector comprises an insulating housing 41 disposed in the opening and a conductive terminal 42 which is held by the housing and electrically connected to the light source module, and wherein the terminal has a grasping portion 47 that grasps the connecting portion in the plate thickness direction.

(Supplementary Note 4)

The illumination device according to supplementary note 3, wherein the housing has a fitting portion 43 that receives therein the connecting portion in a direction crossing the plate thickness direction.

(Supplementary Note 5)

The illumination device according to supplementary note 4, wherein the connecting portion is provided at an end portion of the light source module and is grasped by the grasping portion in the fitting portion.

(Supplementary Note 6)

The illumination device according to any one of supplementary notes 3 to 5, wherein the terminal is manufactured by punching a metal plate.

(Supplementary Note 7)

An illumination device characterized by comprising a support plate 22 having a front surface 22*a* and a back surface 22*b* facing each other in a plate thickness direction and an opening 22*d* passing through in the plate thickness direction, a light source module 23 placed on the front surface of the support plate, and a connector 27 inserted through the opening, wherein the connector is brought into contact with the back surface of the support plate so as to be supported in the plate thickness direction jointly with the light source module.

(Supplementary Note 8)

The illumination device according to supplementary note 7, wherein the support plate has a level difference 22*f* which determines a position of the light source module in cooperation with the connector.

(Supplementary Note 9)

The illumination device according to supplementary note 7 or 8, wherein the connector has a flange 45 that engages with the back surface of the support plate in the plate thickness direction and a fitting portion 43 that is fitted to the light source module and engages with the light source module in the plate thickness direction.

(Supplementary Note 10)

The illumination device according to any one of supplementary notes 7 to 9, wherein the light source module has a connecting portion 23*a*, wherein the connector comprises an insulating housing 41 disposed in the opening and a conductive terminal 42 held by the housing, and wherein the terminal has a grasping portion 47 that grasps the connecting portion in the plate thickness direction in the fitting portion.

(Supplementary Note 11)

The illumination device according to any one of supplementary notes 7 to 10, wherein the support plate has a cutout 22*g* which communicates with the opening and is open to an outer peripheral surface of the support plate.

(Supplementary Note 12)

A connector characterized by comprising an insulating housing 41 and a conductive terminal 42 held by the housing, wherein the housing has a first fitting portion 43 on one end side in a vertical direction and a second fitting portion 44 on an opposite end side, wherein the first fitting portion faces in a direction crossing the vertical direction, and wherein the terminal has a grasping portion 47 that grasps a first connection object in the vertical direction in the first fitting portion and a contact terminal portion 48 that is brought into contact with a second connection object in the second fitting portion.

(Supplementary Note 13)

The connector according to supplementary note 12, wherein the housing has an outward flange 45 between the first fitting portion and the second fitting portion.

(Supplementary Note 14)

The connector according to supplementary note 12 or 13, wherein the first fitting portion has a groove 43*a* and the grasping portion protrudes into the groove.

(Supplementary Note 15)

The connector according to any one of supplementary notes 12 to 14, wherein the second fitting portion has an opening 44*a* and the contact terminal portion has a pin portion 48*a* disposed in the opening.

DESCRIPTION OF SYMBOLS

20 illumination device
21 heat radiating member
22 support plate
22*a* upper surface (front surface) of the support plate
22*b* lower surface (back surface) of the support plate
22*c* receiving recess
22*d* opening
22*e* guide recess
22*f* level difference
22*g* cutout
23 light source module
23*a* connecting portion
24 cover plate
25 screw
26 domed cover
27 fixed-side connector (connector)
28 power supply connector (movable-side connector)
29 power supply cable
31 receiving portion
32 base
33 drive circuit portion
41 insulating housing
42 conductive terminal
43 first fitting portion (fitting portion)
43*a* groove of the first fitting portion
44 second fitting portion
44*a* opening of the second fitting portion
45 flange
46 terminal receiving groove
47 grasping portion
47*a* elastically deformable portion
47*b* contact portion
48 contact terminal portion
48*a* pin portion
49 press-fitting portion

The invention claimed is:

1. An illumination device comprising:

a support plate having a front surface and a back surface facing each other in a plate thickness direction and an opening passing through in the plate thickness direction;

a light source module placed on the front surface of the support plate; and a connector inserted through the opening, wherein the connector is brought into contact with the back surface of the support plate so as to be supported in the plate thickness direction jointly with the light source module;

wherein the support plate has a cutout which communicates with the opening and is open to an outer peripheral surface of the support plate.

2. The illumination device according to claim 1, wherein the support plate has a receiving recess for the light source module, and wherein the receiving recess determines a position of the light source module in cooperation with the connector.

3. The illumination device according to claim 1, wherein the connector has a flange that engages with the back surface of the support plate in the plate thickness direction and a fitting portion that is fitted to the light source module and engages with the light source module in the plate thickness direction.

4. The illumination device according to claim 1, wherein the light source module has a connecting portion, wherein the connector comprises an insulating housing disposed in the opening and a conductive terminal held by the housing, and wherein the conductive terminal has a grasping portion that grasps the connecting portion in the plate thickness direction in the fitting portion.

5. An illumination device comprising:

a support plate having a front surface and a back surface facing each other in a plate thickness direction and an opening passing through in the plate thickness direction;

a light source module placed on the front surface of the support plate;

a drive circuit portion for driving the light source module; and a connector connecting the drive circuit portion to the light source module, wherein the connector is inserted through the opening and brought into contact with the back surface of the support plate, wherein the support plate has a receiving recess which determines a position of the light source module in cooperation with the connector, wherein the light source module has a connecting portion, wherein the connector comprises an insulating housing disposed in the opening and a conductive terminal which is held by the housing, wherein the insulating housing has a fitting portion that receives therein the connecting portion, the fitting portion having a groove which extends in a direction crossing the plate thickness direction and is disposed at a position corresponding to the receiving recess, such that the groove is open toward the receiving recess in a direction perpendicular to the plate thickness direction, and wherein the connecting portion of the light source module is inserted into the groove so that the conductive terminal is electrically connected to the connecting portion and the connector is supported in the plate thickness direction by the back surface of the support plate jointly with the light source module.

6. The illumination device according to claim 5, wherein the conductive terminal comprises metal.

7. The illumination device according to claim 5, wherein the terminal has a grasping portion that grasps the connecting portion in the plate thickness direction.

8. The illumination device according to claim 7, wherein the connecting portion is provided at an end portion of the light source module and is grasped by the grasping portion in the groove of the fitting portion.

9. A connector comprising an insulating housing and a conductive terminal held by the housing, wherein the housing has a first fitting portion on one end side in a vertical direction and a second fitting portion on an opposite end side, wherein the first fitting portion faces in a direction crossing the vertical direction, wherein the terminal has a grasping portion that grasps a first connection object in the vertical direction in the first fitting portion and a contact terminal portion that is brought into contact with a second connection object in the second fitting portion, and wherein the housing has an outward flange between the first fitting portion and the second fitting portion.

10. The connector according to claim 9, wherein the first fitting portion has a groove and the grasping portion protrudes into the groove.

11. The connector according to claim 9, wherein the second fitting portion has an opening and the contact terminal portion has a pin portion disposed in the opening.

* * * * *